US009161572B2

(12) United States Patent
Kesselman et al.

(10) Patent No.: US 9,161,572 B2
(45) Date of Patent: Oct. 20, 2015

(54) STRUCTURES FOR CREATING SMOKING ARTICLES AND METHODS OF PACKAGING SAME

(75) Inventors: Joshua D. Kesselman, Vancouver (CA); Charles Bachmann, Phoenix, AZ (US)

(73) Assignee: BBK TOBACCO & FOODS, INC., Phoenix, AZ (US)

( * ) Notice: Subject to any disclaimer, the term of this patent is extended or adjusted under 35 U.S.C. 154(b) by 1341 days.

(21) Appl. No.: 11/763,865

(22) Filed: Jun. 15, 2007

(65) Prior Publication Data

US 2008/0308431 A1 Dec. 18, 2008

(51) Int. Cl.
*A24F 17/00* (2006.01)
*A24D 1/02* (2006.01)

(52) U.S. Cl.
CPC ..... *A24F 17/00* (2013.01); *A24D 1/022* (2013.01)

(58) Field of Classification Search
CPC ..... A24F 17/00; A24D 1/022
USPC ..... 206/237, 460; 131/365; 221/22, 33, 48
See application file for complete search history.

(56) References Cited

U.S. PATENT DOCUMENTS

| | | | | |
|---|---|---|---|---|
| 83,552 | A | 10/1868 | Ryan | |
| 1,145,268 | A | 7/1915 | Rossy | |
| 1,479,458 | A | 1/1924 | La Mota | |
| 1,631,048 | A | 5/1927 | Miller | |
| 1,670,343 | A | 5/1928 | Clemens | |
| 1,983,530 | A | 12/1934 | Brandenberger | |
| 1,995,068 | A | 3/1935 | Lim | |
| 2,125,618 | A * | 8/1938 | Nystrand | 221/48 |
| 2,170,147 | A | 8/1939 | Lane | |
| 2,202,322 | A * | 5/1940 | Scull | 221/48 |
| 3,395,714 | A | 8/1968 | Kahane | |
| 3,586,005 | A | 6/1971 | Lippman, Jr. et al. | |
| 3,692,176 | A | 9/1972 | Templeton et al. | |
| D243,350 | S | 2/1977 | Shibata | |

(Continued)

FOREIGN PATENT DOCUMENTS

| | | |
|---|---|---|
| CA | 2243807 | 7/1998 |
| DE | 3300302 A1 | 7/1984 |

(Continued)

OTHER PUBLICATIONS

Written Opinion of PCT/US/2004/029882 published on Apr. 21, 2005.

(Continued)

*Primary Examiner* — Bryon Gehman
*Assistant Examiner* — Brijesh V. Patel
(74) *Attorney, Agent, or Firm* — Weiss & Moy, P.C.; Jeffrey D. Moy

(57) ABSTRACT

Aspects of the invention generally provide methods and structures for rolling paper structures for an end user to create a cigar or cigarette. In one aspect, a rolling paper structure is provided including a first paper section having a first height, a second paper section coupled to the first paper section and the second paper section having a second height longer than the first height, and an optional adhesive disposed on the second paper section. The rolling paper structure may be folded between the first paper section and the second paper section having a portion extending beyond the first paper section. A plurality of the rolling paper structures may be disposed in a storage structure. A method for disposing rolling paper structures in and retrieving rolling papers structures from the storage structure is also provided.

2 Claims, 2 Drawing Sheets

(56) References Cited

U.S. PATENT DOCUMENTS

| | | | | | |
|---|---|---|---|---|---|
| 4,033,358 | A | | 7/1977 | Harrington | |
| 4,104,431 | A | | 8/1978 | Luke | |
| 4,146,041 | A | | 3/1979 | Laszlo | |
| 4,235,189 | A | * | 11/1980 | Severin | 118/119 |
| 4,290,592 | A | | 9/1981 | Kastner | |
| 4,435,202 | A | | 3/1984 | Koizumi et al. | |
| 4,436,202 | A | | 3/1984 | Berkley | |
| D277,034 | S | | 1/1985 | Ramsdell | |
| D279,507 | S | | 7/1985 | Schechter et al. | |
| 4,700,840 | A | | 10/1987 | Haddock | |
| D296,938 | S | | 7/1988 | Ameringen | |
| 4,775,358 | A | | 10/1988 | Jones | |
| 4,832,057 | A | | 5/1989 | Bale | |
| 5,080,223 | A | | 1/1992 | Mitsuyama | |
| 5,094,253 | A | | 3/1992 | St. Charles et al. | |
| 5,118,554 | A | * | 6/1992 | Chan et al. | 428/126 |
| 5,284,166 | A | | 2/1994 | Cartwright et al. | |
| 5,387,108 | A | | 2/1995 | Crowell | |
| 5,462,070 | A | * | 10/1995 | Rahardja | 131/76 |
| 5,464,073 | A | | 11/1995 | Johannes | |
| 5,609,269 | A | | 3/1997 | Behnke et al. | |
| 5,613,958 | A | | 3/1997 | Kochinke et al. | |
| 5,645,089 | A | * | 7/1997 | Burger et al. | 131/365 |
| 5,657,773 | A | * | 8/1997 | George | 131/365 |
| 5,697,127 | A | | 12/1997 | Tyler | |
| 5,713,406 | A | | 2/1998 | Drury | |
| 5,762,074 | A | | 6/1998 | Garner | |
| 5,782,246 | A | | 7/1998 | Axelrod | |
| 5,873,166 | A | | 2/1999 | Page | |
| 5,927,488 | A | * | 7/1999 | Gray | 206/237 |
| 5,970,777 | A | | 10/1999 | Hunt et al. | |
| 6,000,404 | A | | 12/1999 | Case et al. | |
| D432,263 | S | | 10/2000 | Issa | |
| 6,164,443 | A | * | 12/2000 | Mitchell et al. | 206/242 |
| D438,105 | S | | 2/2001 | Conner et al. | |
| 6,357,448 | B1 | | 3/2002 | Sinclair, Jr. | |
| 6,427,836 | B1 | | 8/2002 | Bolanos | |
| 6,446,793 | B1 | | 9/2002 | Layshock | |
| 6,526,986 | B1 | | 3/2003 | Sinclair, Jr. | |
| 6,571,803 | B1 | | 6/2003 | Bregard | |
| 6,638,613 | B1 | | 10/2003 | Bland | |
| 6,742,525 | B2 | | 6/2004 | Sinclair, Jr. | |
| 6,758,906 | B2 | * | 7/2004 | Maiwald et al. | 118/315 |
| D499,019 | S | | 11/2004 | Sagmeister et al. | |
| 6,854,471 | B1 | | 2/2005 | Sinclair, Jr. | |
| 6,920,865 | B2 | | 7/2005 | Lyon | |
| 6,920,885 | B2 | | 7/2005 | Braun | |
| 7,048,115 | B2 | | 5/2006 | Stringfield | |
| D526,086 | S | | 8/2006 | Mehta | |
| 7,097,896 | B2 | * | 8/2006 | Merrill | 428/126 |
| 7,136,288 | B2 | | 11/2006 | Hoogerdijk | |
| 7,172,672 | B2 | | 2/2007 | Silverbrook | |
| D541,471 | S | | 4/2007 | Mitten et al. | |
| 7,282,249 | B2 | | 10/2007 | Harrison et al. | |
| D558,199 | S | | 12/2007 | Fiorentino | |
| 7,334,725 | B2 | | 2/2008 | Dan | |
| 7,335,725 | B2 | | 2/2008 | Hill et al. | |
| 7,344,072 | B2 | | 3/2008 | Gonzalez et al. | |
| 7,455,176 | B2 | | 11/2008 | Focke et al. | |
| 2002/0083952 | A1 | | 7/2002 | Braun | |
| 2005/0072437 | A1 | | 4/2005 | Gomez | |
| 2005/0072439 | A1 | | 4/2005 | Darwish | |
| 2006/0000481 | A1 | | 1/2006 | Sinclair, Jr. | |
| 2006/0037622 | A1 | | 2/2006 | Bachmann | |
| 2006/0083886 | A1 | | 4/2006 | Harrison et al. | |
| 2006/0150991 | A1 | | 7/2006 | Lee | |
| 2007/0062967 | A1 | * | 3/2007 | Zaidman et al. | 221/48 |
| 2007/0062968 | A1 | * | 3/2007 | Mark et al. | 221/48 |
| 2007/0062976 | A1 | | 3/2007 | Blum et al. | |
| 2007/0221528 | A1 | | 9/2007 | Bobe et al. | |

FOREIGN PATENT DOCUMENTS

| | | | | |
|---|---|---|---|---|
| DE | 9414404 | U1 | | 2/1995 |
| DE | 9414404 | U1 | | 2/1995 |
| DE | 29502062 | U1 | | 6/1996 |
| DE | 19531 061 | A1 | | 2/1997 |
| DE | 202004007772 | U1 | | 10/2004 |
| EP | 934703 | A1 | | 12/1998 |
| GB | 2318992 | A | * | 5/1998 |
| GB | 2336989 | A | | 11/1999 |
| WO | WO 97/25885 | A1 | | 7/1997 |
| WO | WO 97/25886 | A1 | | 7/1997 |
| WO | WO 98/20757 | A | | 5/1998 |
| WO | WO 03/020057 | A | | 3/2003 |
| WO | WO-2004/056661 | A2 | | 7/2004 |

OTHER PUBLICATIONS

International Search Report of PCT/US/2004/029882 published on Apr. 21, 2005.

Design U.S. Appl. No. 29/258,924 filed in the US Patent Office on Apr. 27, 2006.

Design U.S. Appl. No. 29/261,575 filed in the US Patent Office on Jun. 14, 2006.

Utility U.S. Appl. No. 11/671,892 filed in the US Patent Office on Feb. 6, 2007.

Utility U.S. Appl. No. 11/746,503 filed in the US Patent Office on May 9, 2007.

Utility U.S. Appl. No. 11/778,035 filed in the US Patent Office on Jul. 14, 2007.

Notice of Allowability for Design U.S. Appl. No. 29/323,269, filed Aug. 21, 2008.

European Search Report dated Dec. 17, 2009, EP App. No. 09168276.5.

Office Action dated Dec. 23, 2009 for U.S. Appl. No. 29/335,083, filed Apr. 8, 2009.

* cited by examiner

STRUCTURES FOR CREATING SMOKING ARTICLES AND METHODS OF PACKAGING SAME

BACKGROUND OF THE INVENTION

1. Field of the Invention

The present invention relates generally to paper products used by an end user to create their own cigars or cigarettes. In particular, the present invention relates to a paper for rolling tobacco into a cigar or cigarette and method of packaging several of the papers together.

2. Background and Prior Art

Materials or papers used for rolling smoking articles, such as cigars or cigarettes, may be made from a variety of materials such as reconstituted tobacco and paper. These products are commonly referred to as rolling papers or cigarette papers. Typically such papers or "leaves" have an edge coated with adhesive for sealing the rolled smoking article. Conventionally, rolling papers are sold in packs that include several interleaved papers, each folded in half intertwined with one and other. The lower half of each paper provides sufficient resistance to expose the upper half the next paper sheet within an aperture in the top of the pack so that the second sheet can be easily removed as desired. The removed rolling papers are then rolled and sealed using the adhesive, which adhesive properties may be activated by saliva.

However, the half-way fold often does not allow for efficient rolling and sealing of the paper and may result in undesirable characteristics in the smoking product, such as a loosely or improperly rolled cigarette. This can result in uneven or ineffective burning of the tobacco products. As a result, the rolling papers have to be refolded or torn to resize the papers before using, which can damage the paper and/or provide air channels with the existing or new folds, thereby providing a less than satisfactory smoking product made with the rolling papers. In addition, if the end user desires to make a cigar or cigarette with a certain diameter, it may be necessary to resize the paper by tearing or other means to remove part of the side that does not include the adhesive strip before rolling the cigar or cigarette. Hence, for conventional rolling papers, it is inconvenient to have to refold or resize the paper and those actions may result in cigars or cigarettes that have undesirable characteristics or are inconsistent in size.

Also, when the rolling papers are folded in half, the adhesive may contact and inadvertently adhere to another part of the rolling paper, such as the far edge of the paper. An inadvertent adherence of the adhesive portion of the rolling paper may make the tobacco rolling and sealing process difficult, render the rolling paper useless for the intended purpose or result in the paper becoming less than effective for the rolling and sealing process.

Further, conventional rolling papers are sold at standard heights. Containers for holding such papers are designed for the half-folded paper and may not be suitable for rolling papers having different heights than normally used and having a fold that is off-center.

Therefore, there is a need for an improved rolling paper so that it can be used by an end user to create cigar or cigarette of the desired diameter without the need to refold or resize the paper and to improve the packaging for those papers so that it can effectively dispense the improved paper.

SUMMARY OF THE INVENTION

Aspects of the invention generally provide methods and structures for paper structures used by an end user to create a cigar or cigarette and for packaging those paper structures. In one aspect, a paper structure is provided including a first paper section having a first height, a second paper section coupled to the first paper section and the second paper section having a second height longer than the first height, a fold disposed between the first paper section and the second paper section, and an adhesive disposed on the second paper section having an orientation facing the first paper section. In one embodiment of the paper structure, when folded between the first and second paper sections, the paper structure may have a adhesive on the inner side of the second paper section, and the fold located between the first and second paper sections is positioned to allow the end user to create a cigar or cigarette of a certain size without refolding or resizing the paper structure.

In another aspect, a storage structure for containing paper structures is provided including a body defining an enclosure with an aperture disposed on a side of the body, a plurality of paper structures disposed in the enclosure, and each of the plurality of paper structures includes a first paper section having a first height, a second paper section coupled to the first paper section and the second paper section having a second height longer than the first height, a fold disposed between the first paper section and the second paper section and the second paper section is disposed in a vertical manner with respect to the first paper section, and at least one of the plurality of paper structures is disposed through the aperture and each subsequent paper structure is disposed with the second paper section of the subsequent paper structure disposed between the first paper section and the second paper section of a prior paper structure. The paper structure may further comprise an adhesive disposed on the second paper section.

In another aspect, a method is provided for processing paper structures in a storage structure, including providing a storage structure having a bottom, a top having an aperture formed therein, and a plurality of vertical sidewalls disposed between the bottom and top, providing a plurality of rolling paper structures sequentially disposed in the enclosure, the plurality of rolling paper structure comprises at least a terminal rolling paper structure and at least one subsequent rolling paper structure in a vertically disposed manner from the terminal paper structure, and each of the plurality of rolling paper structures comprise a first paper section having a first height, a second paper section coupled to the first paper section and the second paper section having a second height longer than the first height, and a fold disposed between the first paper section and the second paper section and the second paper section is disposed in vertical manner with respect to the first paper section, and disposing the second paper section of each of the subsequent rolling paper structures between the first paper section and the second paper section of a prior rolling paper structure, and providing at least one subsequent rolling paper structure to the bottom of the storage structure.

In another aspect a rolling paper is provided including a first paper section having a first height, a second paper section coupled to the first paper section and the second paper section having a second height longer than the first height, a fold disposed between the first paper section and the second paper section and the second paper section is disposed in vertical manner with respect to the first paper section, a first adhesive disposed along a width edge of the second paper section and having an orientation facing the first paper section and a second adhesive disposed along a height edge of the first paper section and the second paper section.

DETAILED DESCRIPTION OF THE PREFERRED EMBODIMENTS

Figure 1A:
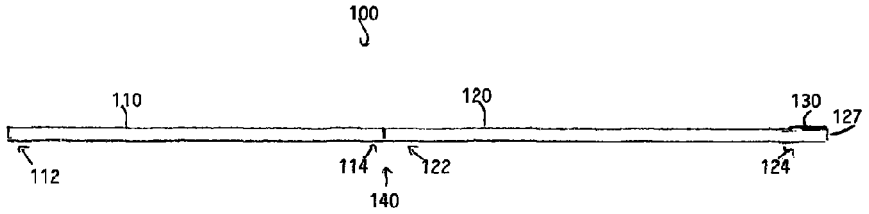
FIG. 1A is a schematic side view of one embodiment of a paper structure.

Aspects of the invention generally provide methods and structures for paper structures, such as rolling paper structures. Referring to FIG. 1A, one embodiment of a paper structure 100, such as a rolling paper structure, is shown in a schematic side view. The paper structure 100 includes a first paper section 110, a second paper section 120, and an optional adhesive 130 disposed on the second paper section 120. The paper structure 100 also has a thickness 127.

The first paper section 110 has a first end 112, a second end 114 opposite the first end 112, and a first length, or first height, between the first end 112 and the second end 114. The length of the paper is commonly referred to as a "height" in the industry. The second paper section 120 has a third end 122, a forth end 124, and a second height between the third end 122 and the fourth end 124.

Figure 1B:
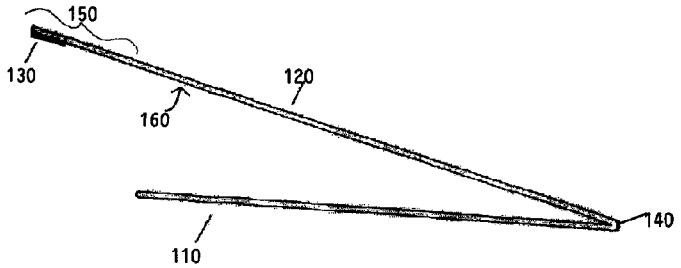
FIG. 1B is a schematic side view of another embodiment of a paper structure.

The second paper section 120 has a second length, or second height, that comprises greater than 50% of the sum of the heights of the first paper section 110 and the second paper section 120. In one embodiment of the paper structure 100, the second paper section 120 may have a second height between about 55% and about 90%, such as between about 65% and about 85%, for example, about 67%, of the sum of the heights of the first paper section 100 and second paper section 120. The second paper section has a second height that provides for forming a portion 150 of the second paper section that extends beyond the first paper section 110 when folded as shown in FIG. 1B.

Examples of paper structures 100 may have a first height between about 10 millimeters and about 25 millimeters and may have a second height between about 20 millimeters and about 95 millimeters to form a combined first height and second height between about 30 millimeters and about 110 millimeters at the respective second height percentages described herein. One example of such a paper structure includes a paper structure having a combined first and second heights of 44 mm that may have a first height between about 13 mm and about 19 mm, corresponding to a second height between about 25 mm and 31 mm, for example, about 15 mm or about 16 mm, corresponding to a second height of about 28 mm and 29 mm. A first height between about 12 mm and about 20 mm for paper structures having heights between 38 mm and about 54 mm may be used to form second heights with the indicated second heights within the percentages described herein for the second height. In another example, a paper structure having a combined height of 100 mm may have a first height that is between about 15 mm and about 40 mm corresponding to a second height between about 60 mm and 85 mm, for example, between about 25 mm and about 30 mm corresponding to a second height between about 70 mm and 75 mm at the respective second height percentages described herein.

The percentage of the second height may vary based on the total height of the paper used. It is believed that the second height of the second paper section will decrease with decreasing combined heights, i.e., smaller paper structures, in order to provide a sufficient area on the first paper section for the tobacco products to be deposited. However, the respective heights may vary for papers of different lengths based on the preferences of the end users, and the above examples are provided to illustrate the invention and are not to be interpreted or construed as limiting the scope of the invention.

Figure 2A:
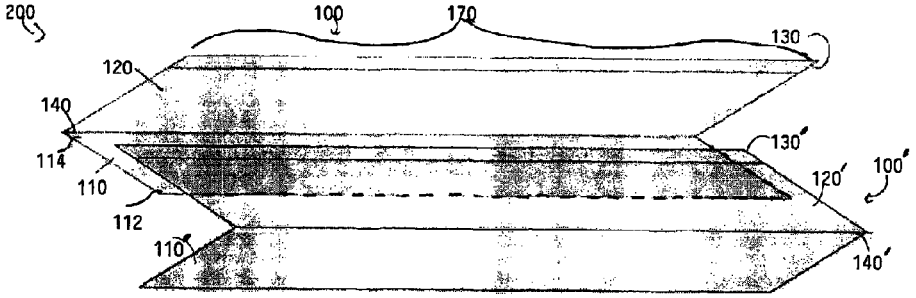
FIG. 2A is a perspective view of one embodiment of interleaved paper structures.

Referring to FIG. 2A, a perspective view of one embodiment of the paper structure 100 is shown having four edges defining a total height as described above and a width 170. The height to width ratio may be between about 1:1 to 1:10, such as between about 1:1.5 and about 1:3, for example, about 1:1.8. Examples of a paper structure of suitable height and width ratio is a paper structure having height of about 38 mm and a width of about 70 mm, for a ratio of about 1:1.8, or a paper structure having a height of about 44 mm and a width of about 79 mm, for a ratio of about 1:1.8, to form a rectangular shape.

The paper structure 100 may be a paper material derived from a plant fiber. Suitable plant fiber materials may be selected from the group of cellulose paper, cellophane (cellulose and glycerin), hemp, palm, banana peel, rice paper, tobacco leaf, flax, wood fiber, and combinations thereof. The paper materials may be of a transparent material, such as transparent cellulose paper or cellophane. The paper material may further be patterned or have designs formed thereon by conventional methods for forming designs on the paper structure. The paper of the paper structure may have a weight between about 8 grams per square meter (gsm) and about 30 gsm if it is bleached or unbleached paper. If homogenized tobacco sheets are used, then the paper weight may be between about 8 gsm and about 50 gsm.

The optional adhesive material 130 is disposed on the second paper section 120. In one embodiment of the paper structure having an adhesive, the adhesive 130 is disposed proximal to an edge of the second paper section 120 such as edge 124 as shown in FIG. 1A. The adhesive 130 may be disposed at a length (height) between about 1% and about 25% of the combined first height and second height of the paper structure 100 along the second paper section 120 as shown in FIG 1A. For example, the adhesive may be deposited at a length of about 9% of the height of the paper structure 100 along the second paper section of a 54 mm height paper structure. Alternatively, the adhesive may be disposed between about 1 mm and about 10 mm of the height of the paper structure 100 along the second paper section 120. For example, the adhesive may be disposed for a length of about 5 mm along the second paper section of a 54 mm height paper structure. The adhesive 130 is preferably disposed along a portion of the second paper section 120 at the terminal end of the of the second paper section as identified as the fourth edge 124 as shown in FIG. 1A.

The adhesive 130 may be disposed on one side of the second paper section 120. Disposing the adhesive on only one side of the section paper section 120 allows the adhesive 130 to have an orientation facing the first paper section 110 when folded as shown in FIG. 1B. In such a configuration, the folded paper structure 100 may have an adhesive disposed on the inner side 160 of the folded paper structure 100. Preferably, the second paper section 120 is disposed vertically above the first paper section 110 as shown in the figure. Alternatively, the first paper section 110 may be disposed vertically above the second paper section 120. The adhesive material 130 may be deposited on all or a portion of the extended portion 150 of the second paper section 120 that extends beyond the first paper section 110 as shown in FIG. 1B. Disposing the adhesive 130 on the extended portion 150 allows the paper structure 100 to be folded along the fold 140 with the adhesive 130 without contact between the adhesive 130 and the first paper section 110.

The adhesive 130 may be transparent, translucent, or opaque material. In one embodiment of the adhesive 130, the adhesive is opaque to indicate which portion and which side of the paper structure 100 the adhesive 130 is disposed. The adhesive 130 may be any adhesive which adheres to the surface of the paper structure. Suitable adhesive materials include a material selected from the group of cellulose based adhesive, such as cellulose gum. One example of cellulose gum is sodium carboxyrnethylcellulose. Additionally, the adhesive may comprise or further include a non-standard formulation containing acacia gum, sugar gum, animal gum, or combinations thereof. The adhesive material may contain other components including water, artificial colorings, artificial flavors, or combinations thereof. One example of an adhesive is a cellulose-based adhesive of ninety-seven percent water, two percent cellulose gum, and one percent flavoring. Artificial colorings, such as a pigment or food coloring, may be added to the adhesive to increase the opacity when dry so that the adhesive line can be seen on the paper structure 100. The artificial coloring and artificial flavors may be components are preferably food grade and the amounts present may be adjusted accordingly to control opacity and flavoring. The adhesive 130 may be applied at a weight in the range of between about 20 grams per square meter ($g/m^2$) and about 110 grams per square meter ($g/m^2$).

The paper structure 100 may be folded to provide the shape as shown in FIG. 1B. The paper structure 100 is folded at the intersection of, or between the, the first paper section 110 and the second paper section 120. Alternatively, the fold 140 may be defined by the second end 122 and the third 124 or the fold 140 may comprise both the second end 122 and the third end 124. The second height which is longer than the first height allows a portion 150 of the second paper section 120 to extend beyond the first paper section 110 when the paper is folded.

Figure 2B:
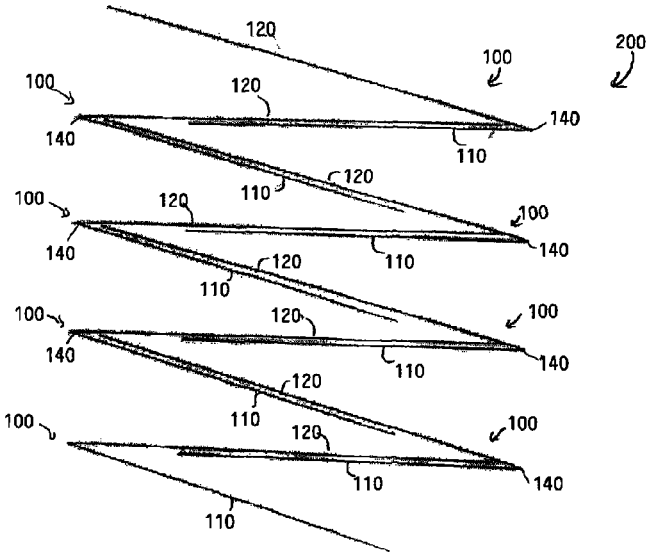
FIG. 2B is a schematic side view of one embodiment of interleaved paper structures.
Figure 3A:
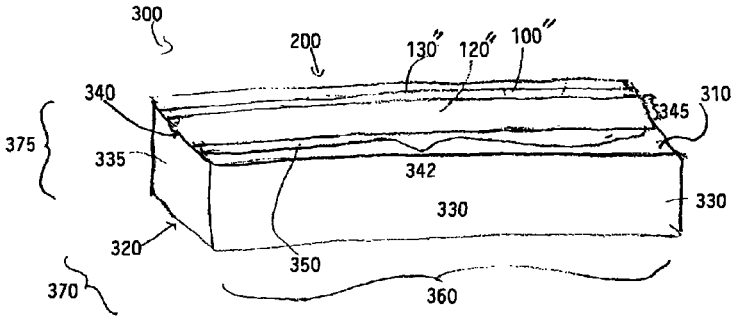
FIG. 3A is a front perspective view of one embodiment of a storage structure.
Figure 3B:
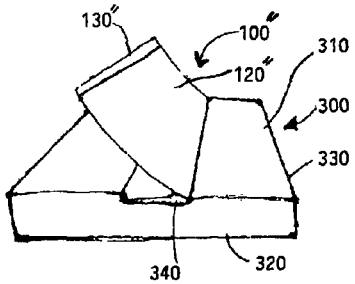
FIG. 3B is a side perspective view of one embodiment of a storage structure.
Figure 3C:
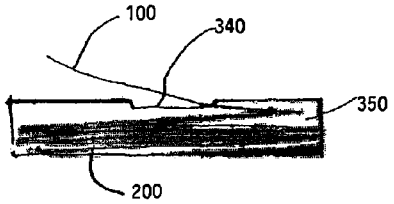
FIG. 3C is a side perspective and side views of one embodiment of a storage structure having a stack of papers structures disposed therein.

FIGS. 2A-2B illustrate perspective and side views of one embodiment of integrating multiple paper structures 100 to form a stack 200 of paper structures 100. The stack may be disposed in a storage structure, such as container 300 as shown in FIGS. 3A-3C. In one embodiment of the stack 200, as shown in FIG. 2A, the second paper section 120 of the paper structure 100 is vertically disposed above the first paper section 110. However, the invention contemplates that a stack 200 may be formed with paper structures 100 having the first paper section 110 vertically disposed above the second paper section 120.

Referring to FIG. 2A, the paper structures 100 may be integrated, or interleaved, by disposing the second paper section 120' of the second paper structure 100' between the first paper section 110 and second paper section 120 of the first paper structure 100. The adhesive 130' of the second paper section 120' may be disposed in a manner as to provide an adhesive face with an orientation directed to the first paper section 110 on which the second paper section 120' is positioned. Positioning the second paper section 120' of the second paper structure 100' provides for the first paper structure 100 and the second paper structure 100' to be vertically displaced from one another for integration into a stack 200. The second paper structure 100' may be horizontally displaced in a direction of 180° degrees, or an opposite orientation, to the first paper structure 100 as shown in FIG. 2A.

FIG. 2B illustrates a plurality of paper structures 100 having been integrated as described with reference to FIG. 2A herein to form a stack 200 having each subsequently integrated paper structure 100 with an opposite orientation and a corresponding downward vertical displacement from the prior paper structure. Such a stack 200 is suitable for positioning in a storage container. The stack 200 may comprise between about 2 and about 200 paper structures, and preferably between about 20 and about 100 paper structures.

The integrated stacked paper structures 100 as shown in FIGS. 2A-2B, also provide for repositioning of the stack of paper structures once a paper structure is removed from the stack. As the top paper structure 100 is pulled in a vertical manner, the first paper section 10 of the top paper structure 100 also vertically displaces the second paper section of the second paper structure disposed between the second paper section and the first paper section of the top paper structure. The second paper structure then assumes the top position of the stack, and such movement can be repeated for the remaining papers in the stack.

FIGS. 3A-3C illustrate a storage structure, such as a container 300, having a top 310, a bottom 320, a front side 330, a back side (not shown), and two end sides 335. The front side 330 defines the width 360 of the container 300, and the end sides 335 define the length 370 of the container 300. The container 300 defines an enclosure 350 in which a stack 200 of paper structures 100 may be disposed. The container 300 may have a width 360 corresponding to between about 0.005% and about 25% greater than the width of the paper structures 100 forming the stack 200 therein, for example, between about 0.5 mm and about 10 mm greater than the width of the paper structures 100.

The container 300 may have a length 370 (corresponding to the height of the paper structure as described herein) between about 0.01% and about 50% greater than the second height of the paper structures 100 forming the stack 200 therein, for example, between about 0.5 mm and about 10 mm greater than the second height of the paper structures 100. The height 375 of the container 300 may vary on the number, weight, and thickness of the paper comprising the paper structures 100 therein.

The top 310 of the container 300 defines an aperture 340. The aperture 340 may have a width 342 between about the width of the paper structure 100 and about 100% of the width 360 of the container 300. In one embodiment of the container 300, the aperture 340 has the same width as the container 300.

With all other considerations being equal such as the number of paper structures 100 in a stack, the respective materials and thickness as well as the size of the container; the aperture may have a length 345 (corresponding to the height of the paper structure 100 as described herein) that varies based on the second height of the paper. In one embodiment, the aperture 345 is increased in length between about 0.25 mm and about 1 mm for every 1 mm increase in the second height of the paper structure from a 50% height of the combined first and second paper sections for a paper structure having a combined first and second heights between about 30 mm and about 100 mm, such as between about 38 and about 54 mm.

For example, a 44 mm combined height paper structure, which conventionally would require a container with a 5 mm aperture length when the paper is folded in half, may require a container with an aperture length between about 6.5 mm and 11 mm (and possibly up to about a 15 mm aperture), for example, about 7 mm, for a second height between about 24 mm and about 37 mm, for example, about 28 mm, of the 44 mm combined height paper structure 100. It is believed by the inventors, for effective removal of paper structures through the aperture of the container, the length of the aperture should generally be increased as the second paper section length is increased beyond the 50% height of the combined first and second paper sections.

The stack 200 is disposed in the enclosure 350 as to provide a second paper section 120" with an adhesive section 130" of a terminal, or top, paper structure 100" to be disposed through the aperture 340. The integrated paper structures of the stack 200 allows for the top paper structure 100" to be removed from the stack 200 while concurrently positioning the subsequent paper structure to have the respective second paper section disposed through the aperture 340. The removal of the top paper structure with concurrently positioning the subsequent paper structure through the aperture 340 may be repeated for all of the paper structures in the stack 200. While not shown, a cover may be disposed over the aperture and any exposed paper structures to protect the paper structures disposed therein.

The container may be packaged as follow. The container 300 is provided as described above. The container may be in a disassemble or unfolded format, or alternatively, the container may be in a defining enclosure format as shown in FIG. 3A. A stack 200 of the rolling papers 100 described herein may then be placed on the container structure if flat or in the containing structure if the container is formed defining the enclosure. The stack 200 may be formed prior to providing to the container or may be formed in the container. If the container 200 is in the unfolded format after the stack is added or formed, the container 300 may then be folded to form the defining enclosure format as shown in FIG. 3A.

The stack 200 is formed by disposing a first paper structure 100 folded with a second paper section disposed vertically above the first paper section. A second folded paper structure is then interleaved with the first paper structure by disposing the first paper section of the second paper structure under the second paper section of the first folded paper structure. Alternatively, the folded paper sections may be interleaved by positioning the second paper section of the first paper structure between the first paper section and the second paper section of the second paper structure. This process can be repeated with a series of paper structures with each subsequent paper structure, i.e., third, being interleaved with the prior paper structure, i.e., second, as described above for the first and second paper structures to form a stack 200. The final paper structure, or terminal paper structure, is then positioned to have the respective second paper section disposed through the aperture in the container.

In operation, the second paper section of a terminal rolling paper structure of the one or more subsequent rolling paper structures is disposed through the aperture. The second paper section may then be pulled to remove the terminal paper structure. As the terminal paper structure is pulled, the first paper section of the terminal paper structure lifts or repositions the second paper section of the next paper structure through the aperture. The process is then repeated until all of the paper structure are removed from the container.

It is believed that the paper structures described herein provides for ease of use of rolling papers without the need to resize or reshape the paper to be used. It is also believed that the storage structure herein provides for removal and replacement of paper structures with folds at greater than 50% of the height of the paper structure.

Figure 4:
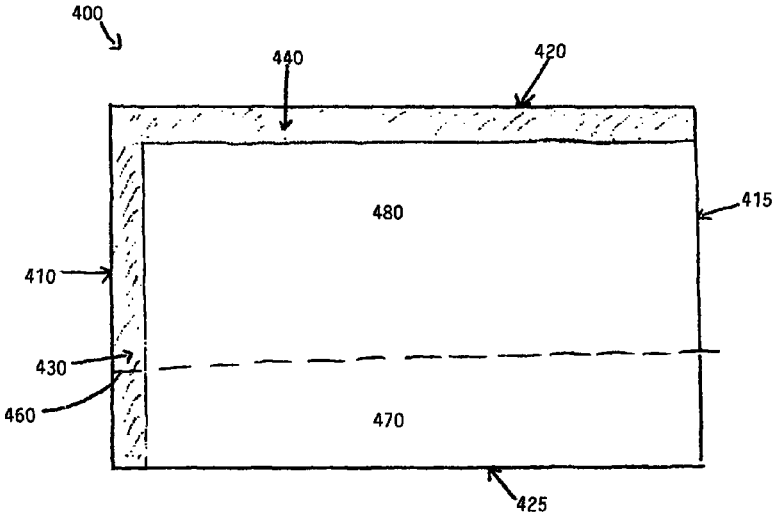
FIG. 4 is a top view of another embodiment of a rolling paper structure of the invention described herein.

Referring to FIG. 4, a second embodiment of the disposition of adhesives on a paper structure described herein is illustrated. The paper structure 400 has a length, also referred to as a height, having a first height edge 410, second height edge 415 and a width having a first width edge 420 and a second width edge 425, a first paper section 470, and a second paper section 480. A first adhesive 430, an adhesive is also known as a gumline, is deposited along the length of at least one of the first height edge 410 or second height edge 415 edge, and a second adhesive 440 is deposited along the width of at least one of the first width edge 420 or second height edge 425. A fold 460 may intersect one of the adhesives 430, 440 such as a fold along the height intersecting adhesive 430 at the intersection of a first section 470 and a second section 480 as shown in FIG. 4. The adhesives 430 and 440 may be disposed on the same side of the paper structure with the adhesive 440 disposed as to have an orientation directed to the first section when the paper structure 400 is folded.

The adhesive 440 may be disposed at a length (height) between about 1% and about 25% of the height of the paper structure 400 along at least one of the first width edge 420 or second height edge 425 as shown in FIG. 4. The adhesive 430 may be disposed at a width (height) between about 1% and about 25% of the width of the paper structure 400 along at least one of the first height edge 410 or second height edge 415 edge as shown in FIG. 4. For example, the adhesive may be deposited at about 9% of the height and/or width of the paper structure 400 along the respective edges of a 54 mm height paper structure. Alternatively, the respective adhesive layers may be disposed between about 1 mm and about 10 mm of the respective height or width of the paper structure 400 along the respective edges. For example, the adhesive may be disposed at about 5 mm of the height and/or width of the paper structure 400 along the respective edges of a 54 mm height paper structure. The respective adhesives are disposed proximal to the respective edges. The respective adhesives 430 and 440 may intersect at a corner formed by the respective height edges and width edges.

It is possible to use existing rolling paper production technology by modifying it to allow for the adhesive 430. Conventionally, using current production methods, the second adhesive 440 is applied to a large bobbin in bulk. The bobbin is unrolled through a gumming machine during which time an adhesive 440 is applied and dried. In order to implement the adhesive 430, a separate machine to apply gum may be employed or the gum can be applied onto each sheet after it has been cut. Alternatively, a double-width gumline extending widthwise can be applied to the bulk paper, after which it can be cut in two equal halves, resulting in two sheets, each with the appropriate adhesive 430.

A filter (not shown), such as a cellulose acetate or paper filter although any type of filter appropriate for use in smoking may be used with the respective adhesives 430 and 440. In practice, the rolling paper 400 is moistened along the adhesives 430, 440 after rolling the paper 400 around the tobacco. The adhesive 440 is used to adhere the rolling paper 400 to itself, with the adhesive 430 being used to adhere the rolling paper 400 to an inserted filter. The two adhesive paper structures 400 may be also be packaged as described herein.

Although exemplary embodiments of the present invention have been shown and described, many changes, modifications, and substitutions may be made by one having ordinary skill in the art without necessarily departing from the spirit and scope of the invention.

What is claimed is:

1. A rolling paper for creating smoking articles, comprising:

a first rolling paper section having a first height;

a second rolling paper section coupled to the first rolling paper section and the second rolling paper section having a second height longer than the first height;

an off-center, pre-positioned fold disposed between the first rolling paper section and the second rolling paper section and the second rolling paper section is disposed in vertical manner with respect to the first rolling paper section, wherein the off-center, prepositioned fold is located such that a smoking article may be created without refolding or resizing the rolling paper;

a first adhesive for adhering the rolling paper to itself, wherein the first adhesive is disposed along a width edge of the second rolling paper section and having an orientation facing the first rolling paper section; and a second adhesive for adhering the rolling paper to an inserted filter, wherein the second adhesive is disposed along a height edge of the first rolling paper section and the second rolling paper section, and wherein the first and second adhesives are selected from the group consisting of cellulose-based adhesives and any mixtures thereof, wherein the first and second adhesives contain an artificial coloring.

2. The rolling paper of claim 1, wherein the first and second adhesives contain an artificial flavoring.

* * * * *